United States Patent [19]

Volk et al.

[11] 4,313,610

[45] Feb. 2, 1982

[54] CARRIAGE FOR ROLLER SKATES

[75] Inventors: Anthony J. Volk, P.O. Box 943, Turlock, Calif. 95380; George L. Volk, Turlock, Calif.

[73] Assignee: Anthony J. Volk, Turlock, Calif.

[21] Appl. No.: 127,900

[22] Filed: Mar. 6, 1980

[51] Int. Cl.[3] ..... A63C 17/02

[52] U.S. Cl. ..... 280/11.28; 280/87.04 A

[58] Field of Search ..... 280/11.19, 11.2, 11.28, 280/11.27, 87.04 A

[56] References Cited

U.S. PATENT DOCUMENTS

| | | | |
|---|---|---|---|
| 320,108 | 6/1885 | Williams | 280/11.19 |
| 329,557 | 11/1885 | Hirt | 280/11.28 |
| 334,896 | 1/1886 | Robinson | 280/11.19 |
| 982,846 | 1/1911 | Nesbitt, Sr. | 280/11.27 X |
| 2,959,423 | 11/1960 | Dornseif | 280/11.28 |
| 3,156,482 | 11/1964 | Ware | 280/11.2 |

FOREIGN PATENT DOCUMENTS

| | | | |
|---|---|---|---|
| 1225789 | 7/1960 | France | 280/11.28 |

*Primary Examiner*—Joseph F. Peters, Jr.
*Assistant Examiner*—D. W. Underwood
*Attorney, Agent, or Firm*—Alvin E. Hendricson

[57] ABSTRACT

An improved truck or undercarriage for a skate and adapted for injection molding has an elongated plastic body and a pair of traverse plastic axle elements with grooved projections through which mounting bolts extend to flexibly clamp the elements against depending V-shaped projections on the body for limited axle pivoting.

8 Claims, 10 Drawing Figures

CARRIAGE FOR ROLLER SKATES

BACKGROUND OF INVENTION

Roller skates have long been known and many advances in construction and components thereof have been made. Present day roller skates are generally provided with wide plastic wheels formed of polyurethane, for example, for silent, smooth skating. Plastic carriages have been developed and many roller skates have limitedly pivotable axles for improved maneuverability. There have also been developed brakes for roller skates and, with all of these and other improvements, the cost of roller skates has risen dramatically. Certain structural difficulties have also been noted in the pivotable axle mounting.

The present invention provides a very simple skate carriage or truck meeting all of the present day requirements which may be injection molded of nylon, for example, for minimizing the cost and maximizing structural strength.

SUMMARY

The present invention has three major parts which may be readily molded from a suitable plastic, such as nylon. An elongated body has two transverse axle elements bolted to the underside thereof for mounting skate wheels. Each of the axle elements has a central lateral projection with a groove extneding along the underside thereof and across the element for fitting onto a V-shaped or ribbed projection on the underside of the body. The groove and rib contact is disposed at an angle to horizontal and vertical and a mounting bolt extends through each element and mating body projection. A resiliently compressible element separates each mounting bolt and axle element for providing limited pivoting of each axle element.

The roller skate structure of this invention also includes a friction brake in the form of a fifth wheel tightly mounted for forceable rotation between a pair of depending body portions above the bottom of the skate wheels. The friction may be adjusted and the wheel may be engaged with the ground by tilting the skate to thus slow down the speed of the skate. A stop or support may also be provided as a flat ended element secured to the underside of the truck at the opposite end thereof from the friction brake. With the skate tilted toward the stop, a substantial surface thereof will engage the ground to prevent rolling of the skate when it is desired to stand still on the roller skates.

DESCRIPTION OF FIGURES

The present invention is illustrated as to a single preferred embodiment in the accompanying drawings, wherein.

DESCRIPTION OF PREFERRED EMBODIMENT

Figure 1:
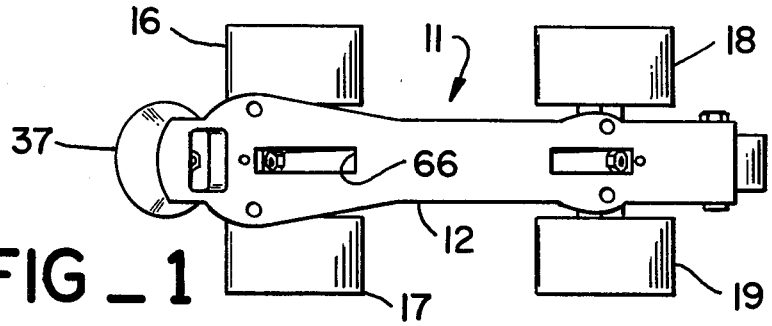
FIG. 1 is a top plan view of a roller skate truck or carriage in accordance with the present invention.
Figure 2:
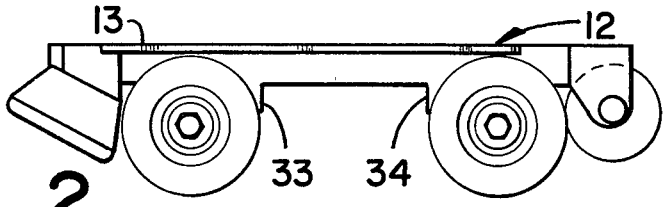
FIG. 2 is a side elevation of the skate of FIG. 1.
Figure 3:
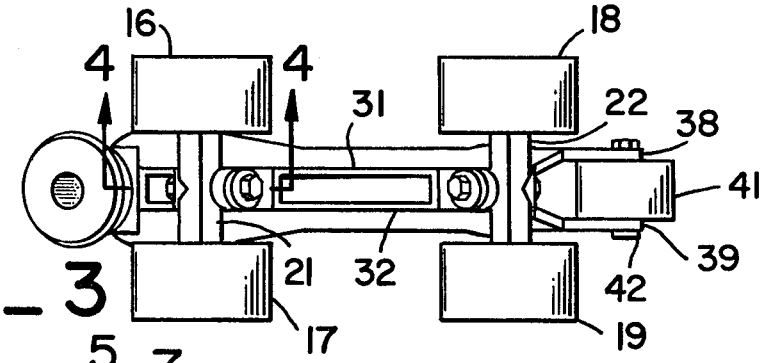
FIG. 3 is a bottom plan view of the skate of FIG. 1.

The present invention, as illustrated in the accompanying drawings, will be seen to comprise a truck or carriage 11 having an elongated body 12 with a planar upper surface 13 adapted to receive a shoe or the like which may be attached thereto in conventional manner. The body 12 is mounted on four wheels 16, 17, 18 and 19. A first pair of wheels 16 and 17 are mounted for rotation at opposite ends of a first axle element 21 and a second pair of wheels 18 and 19 are rotatably mounted at opposite ends of a second axle element 22.

A truck or carriage body 12 has a planar upper surface 13, as noted above, and is strengthened by integral longitudinal ribs 31 and 32 on the underside thereof. A pair of mounting blocks or protuberances 33 and 34 are disposed in spaced-apart relation longitudinally of the body on the underside thereof with the ribs 31 and 32 extending therebetween. At one end of the body 12 there is provided a projection 36 for mounting of a resilient stop 37. This stop may take the form of a generally cylindrical element having a flat lower surface, inclined with respect to the planar top 13 of the body, so that the carriage may be tilted on the wheels 16 and 17 to engage the flat end of the stop with the ground or surface supporting the skate to hold the carriage from rolling. A suitable mounting bolt is extended through the stop into threaded engagement with a nut disposed and preferrably held in the aperture in the projection 36.

At the other end of the carriage from the stop 37, there are provided a pair of depending mounting plates 38 and 39 for tightly engaging the sides of a brake wheel 41 mounted for rotation on a shaft 42 extending through the plates and wheel. This brake wheel or friction wheel 41 is mounted above the ground so as to be clear of same during normal operation of the skate. Pivoting of the truck or carriage 11 about the wheels 18 and 19 will lower the brake wheel 41 into engagement with the surface upon which the main wheels of the skate normally ride. This will cause the brake wheel 41 to be forceably rotated by the movement along a supporting surface to thus act as a brake. The shaft 42 may be provided as a bolt with a nut threaded on the end thereof so that tightening of the nut will force the mounting plates 38–39 together to increase the friction on the brake wheel 41. Thus the amount of friction is adjustable by the user to accommodate fast or slow stops. The strengthening or reinforcing ribs 31 and 32 are also noted to extend between the mounting block 34 and plates 38 and 39 as well as to extend at the other end of the body from the mounting block 33 to the projection 36.

Figure 4:
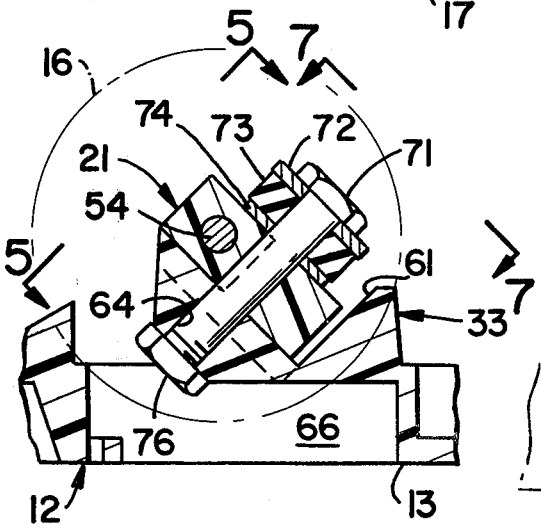
FIG. 4 is a partial sectional view taken in the plane 4—4 of FIG. 3.
Figure 5:
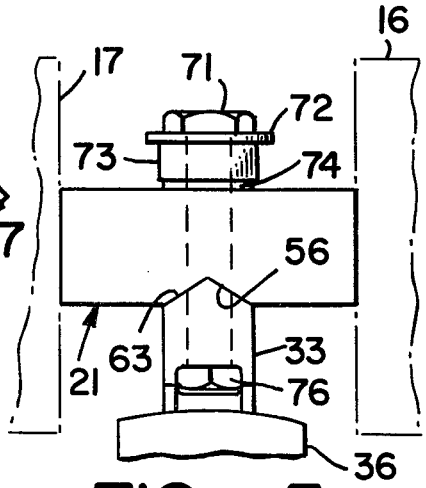
FIG. 5 is a partial view taken in the plane 5—5 showing mounting of an axle element.
Figure 6:
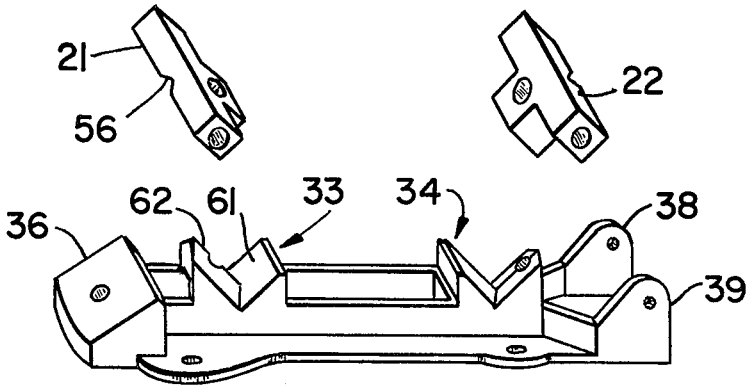
FIG. 6 is an exploded perspective view of the truck body and axle elements.
Figure 8:
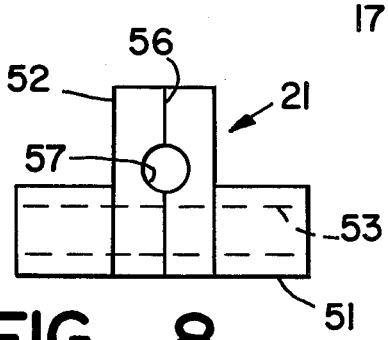
FIG. 8 is a side elevational view of an axle element.

Considering now the mounting of the wheels of the roller skate, it is noted that the pairs of wheels 16–17 and 18–19 are mounted by mirror-image mounting means and thus only the mounting of wheels 16–17 is described in detail. FIGS. 4 and 5 are particularly directed to the mounting means and FIGS. 6 and 8 illustrate the elements thereof. The axle element 21 will be seen to be comprised of a T-shaped unit having a cross-piece 51 with a short central lateral extension 52. This element 21 may be molded as a single piece from a tough resilient plastic such as nylon. A central longitudinal bore 53 longitudinally through the cross piece 51 is provided to accommodate an axle 54 mounting the skate wheels 16 and 17. A V-shaped groove 56 is formed longitudinally of the lateral projection 52 and continues across the cross piece 51 and a bolt hold 57 extends laterally through the extension 52 substantially at the juncture thereof with the cross piece 51.

The above-identified axle element is adapted to fit into the notched undersurface of the mounting block 33. The mounting block 33 has the notched undersurface thereof formed by inner and outer upwardly inclined surfaces 61 and 62 respectively, as best shown in FIG. 6 of the drawings. The outer inclined surface 62 has a central longitudinal V-shaped rib 63 thereon of a configuration to mate with a V-groove 56 in the axle element 21. A bolt hole 64 extends perpendicularly through the outer inclined surface 62 into communication with a recess 66 in the top surface 13 of the body 12. This recess 66 may extend entirely through the body 12 adjacent the mounting blocks 36, as indicated in FIG. 4 of the drawings.

Mounting of the axle element 21 on the body 12 is accomplished by placing the V-groove 56 onto the V-shaped ridge 63 of the mounting block 33. This is illustrated in FIGS. 4 and 5 and, with the bolt holes 57 and 64 aligned, an axle bolt 71 is inserted through the axle unit 21 and the outer portion of themounting block 33. The mounting includes a washer 72 beneath the head of the bolt 71, a resiliently compressible ring 73 beneath the wsher 72 and a washer 74 beneath the ring against the undersurface of the axle unit 21. A nut 76 is threaded on the upper end of the axle bolt 71. Access to the nut 76 on the axle bolt 71 is available through the recess 66 of the truck body 12. The bolt and nut are tightened to compress the ring 73.

Figure 7A:
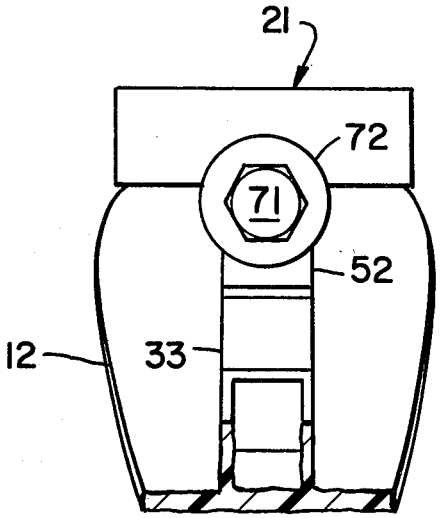
FIGS. 7A and 7B are partial views of a mounted axle element in normal and pivoted position as seen from the plane 7—7 of FIG. 4.

It will be seen that the axle unit 21 is dimensioned relative to the notched mounting block 33 so that the outer end of the lateral projection 52 on the axle unit is spaced from the inner surface 61 of the mounting block. This is clearly shown in FIG. 4 of the drawings and further illustrated in FIGS. 7A and 7B. The truck or carriage body 12 and axle elements 21 and 22 are adapted to be molded from a strong, substantially rigid plastic material such as nylon which provides long wearing quality with substantial strength.

Figure 9:
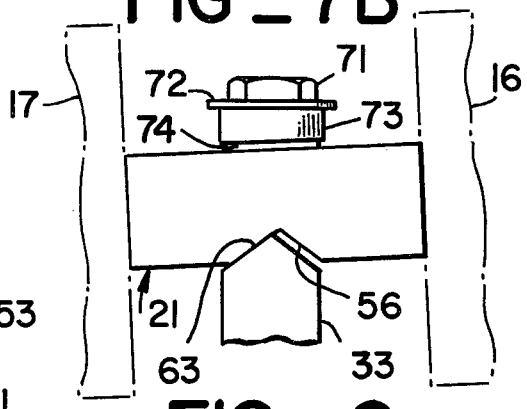
FIG. 9 is a schematic representation of the axle element and body of the present invention showing the relative movement of elements during turning and viewed from the same plane as FIG. 5.

The present invention is also particularly adapted to provide a mounting arrangement whereby the skate wheels may be pivoted during turning operations and the above-described mounting arrangement does provide this capability. In this respect reference is made to FIGS. 7A and 7B wherein the relationship of axle element 21 and truck body 12 is illustrated from the plane 7—7 of FIG. 4 and to FIG. 9 illustrating the manner in which the axle element rides over the rib 63 of the body mount 33, as viewed from the plane 5—5.

Figure 7B:
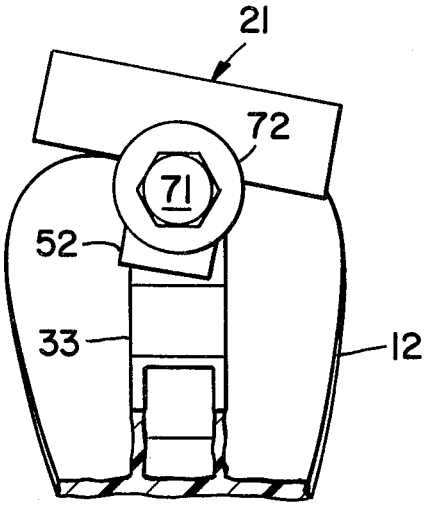

The axle mounting includes a compressible ring 73 about the mounting bolt 71, as noted above, and this ring is adapted to be resiliently compressed during turning operations of the skate. A downward pressure on one side of the forward portion of the skate will cause the body 12 to be forced downwardly toward the ground or surface upon which the skate wheels rest. This will cause the compression ring 73 to be compressed on one side thereof, as indicated in FIG. 9 whereby the axle 21 rides up on the V-shaped rib 63 on the mounting block 33 as the axle pivots. In FIG. 7B pivoting of the axle element 21 is shown in exaggerated position and in FIG. 9 the riding of the axle element up upon the V-shaped surface 63 is indicated. Compression of the ring 73 is also indicated in FIG. 9. It will be noted that the pivotal movement of the axle element 22 is quite limited by engagement of the projection 52 with the mounting block surface 61. The ease of pivoting of the axles is readily controlled by the degree of tightening of the nut 76 on the mounting bolt 71. This then determines the force that must be overcome to force the axle element to ride up on the V-shaped surface of the mounting block. Some skaters prefer a relatively easily pivoted wheel arrangement and others prefer a very stiff wheel mounting. It is, however, noted that this limited pivoting of the skate axle occurs automatically by downward pressure on one or the other sides of the skate body as normally occurs during turning operations by a skater.

It will be seen that the present invention provides a simple, rugged roller skate carriage or truck which may be formed quite inexpensively and yet which provides all of the capabilities of complex and expensive structures. The body and axle elements of the present invention may be readily formed by injection molding, for example, to thus provide a clear and substantial advance in the art. Although the present invention has been described with respect to a single preferred embodiment thereof, it will be appreciated that variations and modifications are possible within the spirit and scope of the present invention, and thus it is not intended to limit the invention to the details of illustration or precise terms of description.

What is claimed is:

1. A roller skate truck comprising an elongated body having a pair of depending longitudinally-spaced mounting blocks with V-shaped under surfaces, with the surfaces adjacent the ends of said body having convex configurations laterally thereacross, a pair of axle elements adapted to receive wheel axles longitudinally thereof and each having a concave depression laterally thereacross for engaging the convex mounting block surfaces, and mounting means including bolts adapted to extend through said axle elements and mounting blocks with resiliently compressible elements thereabout for accommodating limited pivoting of said axle elements by shifting of the concave-convex engagement of mounting block and axle element.

2. The combination of claim 1, further defined by said mounting blocks being integral with said body and disposed one adjacent each end of said body.

3. The combination of claim 1 further defined by said convex configurations each comprising a V-shaped rib adapted to mate with a V-shaped depression in an axle element.

4. The combination of claim 1 further defined by said axle elements each having a central lateral projection across which said concave depression extends and the end of which is disposed in predetermined spaced relation with the surface of said V-shaped mounting block depression adjacent the center of said body for limiting pivotal movement of said axle elements relative to said body.

5. The combination of claim 1 further defined by said body and mounting blocks being integrally formed of injection molded nylon and said axle elements being injection molded of nylon.

6. The combination of claim 1 further defined by the resiliently compressible elements of said mounting means each including a resiliently compressible ring disposed between washers beneath a bolt head for compression of a side of the ring to allow movement of the mounted axle element on a mounting block.

7. The combination of claim 1 further defined by said body having a pair of integral depending mounting plates adjacent an end of the body and a brake wheel mounted for rotation between said plates in tight frictional engagement therewith for controlled engagement with a support surface to frictionally brake skate movements thereover.

8. An improved roller skate carriage comprising an elongated body having a pair of integral, longitudinally spaced, depending mounting blocks with each having a V-shaped notch in the underside thereof with the side of the notch adjacent an end of the body having a convex, V-shaped mounting surface, a pair of T-shaped axle elements with an aperture through the top portion and a V-shaped depression along the top of the shank and across the top for mating with the V-shaped mounting surface of the mounting blocks, and mounting means including an axle bolt extending through each axle element and mounting block normal to said mounting surface and including a resiliently deformable ring about each axle block whereby tightening of the bolt compresses the ring to force said V-shaped surfaces together in mating relation and downward pressure on either side of said body resiliently deforms said ring to cause said axle element to pivot on said mounting block.

* * * * *